United States Patent [19]

Avison et al.

[11] 4,304,741

[45] Dec. 8, 1981

[54] GAS INJECTION APPARATUS

[75] Inventors: Gerald Avison; John K. Conway; David J. Targell, all of Cambridge, England

[73] Assignee: Clearline Home & Leisure Products Ltd., London, England

[21] Appl. No.: 189,855

[22] Filed: Sep. 22, 1980

[30] Foreign Application Priority Data

Sep. 21, 1979 [GB] United Kingdom ..... 32787/79

[51] Int. Cl.[3] ..... B01F 3/04

[52] U.S. Cl. ..... 261/121 R; 99/275; 99/323.1; 206/0.6; 220/334; 261/61; 261/DIG. 7; 312/31.1; 312/31.2; 426/477

[58] Field of Search ..... 261/61, 121 R, 122–124, 261/DIG. 7, DIG. 65; 312/31.1–31.3; 220/334; 206/0.6; 99/275, 323.1; 426/474, 477

[56] References Cited

U.S. PATENT DOCUMENTS

| | | | |
|---|---|---|---|
| 751,397 | 2/1904 | Hucks, Jr. | 261/DIG. 7 |
| 1,573,690 | 2/1926 | Edwards | 261/121 R |
| 2,149,670 | 3/1939 | Fetterly | 261/DIG. 7 |
| 2,342,972 | 2/1944 | Roy et al. | 261/121 R |
| 2,361,137 | 10/1944 | Terry et al. | 261/121 R X |
| 2,492,309 | 12/1949 | Miller | 261/121 R X |
| 2,555,726 | 6/1951 | Beyrodt | 261/121 R X |
| 2,600,901 | 6/1952 | Meldau | 261/DIG. 7 |
| 3,617,032 | 11/1971 | Tracy | 261/DIG. 7 |
| 4,093,681 | 6/1978 | Castillo et al. | 261/122 |
| 4,098,853 | 7/1978 | Brown et al. | 261/DIG. 65 |

FOREIGN PATENT DOCUMENTS

| | | | |
|---|---|---|---|
| 52210 | 2/1933 | Norway | 261/DIG. 7 |
| 392750 | 5/1933 | United Kingdom | 261/DIG. 7 |
| 1453363 | 10/1976 | United Kingdom | 261/DIG. 7 |
| 1468469 | 3/1977 | United Kingdom | 261/DIG. 7 |

*Primary Examiner*—Richard L. Chiesa
*Attorney, Agent, or Firm*—Cushman, Darby & Cushman

[57] ABSTRACT

An apparatus for injecting gas under pressure into liquid held in a bottle 5, primarily for injecting carbon dioxide gas into beverages in order to make "fizzy" drinks in the home or other small establishments, comprises a base member 1 including a platform 4 to support the bottle. A housing member 2 is pivoted to the base member about a generally horizontal axis 3 spaced horizontally from the platform so that when the apparatus is opened the bottle can be placed upon, or removed from, the platform. When the apparatus is closed, a dip tube 9 penetrates through the open top of the bottle to permit the injection of gas from a cylinder housed within the base member under the control of a lever 11.

20 Claims, 4 Drawing Figures

GAS INJECTION APPARATUS

The present invention relates to an apparatus for injecting gas under pressure into a liquid. Particularly, though not exclusively, the invention is concerned with an apparatus for injecting carbon dioxide gas into water or other beverage to enable the user to make "fizzy" drinks in the home or other small establishments.

Carbonating apparatus of this character is already known, and has been described, for example, in British patent specifications Nos: 1,453,363 and 1,468,469. Such apparatus comprises means to receive an open topped bottle containing the beverage to be carbonated, a gas injection orifice adapted to penetrate through the top of the bottle into the liquid, a coupling to receive a cylinder of the compressed gas, a flow line to lead gas from the cylinder to the injection orifice and a user operable valve to alternatively permit or prevent the flow of gas through such line and into the liquid.

In each of the above mentioned prior examples the bottle is received in an open-bottomed tubular shroud intended to protect the user from injury in the event of the bottle shattering during carbonation, and the injection orifice is provided at the end of a dip tube which extends downwardly through part of the length of the shroud. The shroud is pivoted to the rest of the apparatus about a horizontal axis lying on an upper extension of the longitudinal axis of the shroud, so that the pivot point lies vertically above the aftermentioned platform. By this means the shroud can be swung away from its usual vertical orientation to permit a bottle to be inserted through the open bottom end of the shroud with the dip tube penetrating through the open top of the bottle. Then the shroud is swung back into the apparatus to bring the enclosed bottle to rest upon a platform. Carbonation takes place in this position and thereafter the shroud can be swung out once more to enable the bottle of carbonated beverage to drop out into the user's hand.

This procedure is not entirely satisfactory in that so long as the shroud is in its "swung out" position the apparatus provides nothing to prevent the bottle from falling out through its open bottom. This requires that during the loading and unloading of a bottle from the apparatus the user must at all times keep the bottom end of the shroud covered with his hand, while simultaneously swinging the shroud inwards or outwards as appropriate. Should he forget to cover the bottom end when swinging the shroud out following carbonation there is the danger that the bottle will fall and shatter, or at least that its contents will be spilled.

The invention seeks to overcome this operational inconvenience of prior home carbonating devices and according to the invention an apparatus for injecting gas into liquid contained in an open topped vessel comprises a base member including a platform to support such a vessel, a housing member pivoted to the base member about a generally horizontal axis spaced horizontally from said platform, the housing member including a gas injection orifice, a coupling for receiving a source of compressed gas and connected to a conduit defining a flow path to lead gas from such source to the injection orifice and a valve means, or means to operate a valve on the gas source, operable in response to the movement of a manipulable control member to permit or prevent the flow of gas to the orifice, the housing member being pivotal between a first position which permits a vessel to be placed upon or removed from said platform without penetration of the injection orifice into the vessel, and a second position in which the injection orifice penetrates through the top of a vessel previously placed upon the platform.

An advantage of an apparatus according to the invention as applied, e.g. to a home carbonating device is that, in operation, a bottle or other such vessel is placed upon the platform of the base member without interference from the injection orifice while the housing member is in its first position, then the housing member is pivoted to its second position and the carbonation performed, the housing member is then pivoted back into its first position with the bottle still standing on the platform and finally the bottle of carbonated beverage is removed from the platform again without interference from the injection orifice. As a result, the dexterity required of the user is minimal and at no time during the procedure is there any danger of the bottle falling out of the apparatus.

Although the apparatus avoids the use of a pivoted shroud for inserting and removing each bottle, with the disadvantages previously mentioned, a shock resistant shroud is nevertheless preferably included in the housing member so that when the housing member is in its second pivoted position it envelopes a vessel previously placed upon the platform to protect the user from injury in the event of a vessel failure during or after gas injection and which, when the housing member is in its first position, does not interfere with the vessel being placed upon or removed from the platform as previously described.

Another feature of the carbonating devices disclosed in each of the above mentioned prior British patent specifications is concerned with the need for the bottle containing the beverage to be carbonated to be held securely within the apparatus, and for its open top to be sealed around the dip tube in a gas tight manner, during carbonation. To this end each of the prior devices has a bung-like seal secured in the top end of the shroud around the dip tube, which is received in the mouth of the bottle, and during carbonation the bottle is clamped longitudinally between this seal and the platform on which the bottle stands. In U.S. Pat. No: 1,453,363 the seal is fixed in position and a firm clamping action is achieved by raising the platform through a cam and lever mechanism to thereby press the bottle upwards against the seal. In U.S. Pat. No: 1,468,469 the seal is biased downwards against the bottle by a spring, and this biasing action is reinforced during carbonation by the seal acting as a differential piston under the applied gas pressure. By clamping the bottle in this way, it follows that the pressure loads set up during carbonation (whose tendency is to expel the bottle downwards and the seal upwards) must be reacted by the structure of the apparatus at the opposte ends of the bottle. The apparatus must therefore have a frame or casing structure inter-linking the platform and seal (and thus including the pivot for the shroud/dip tube assembly) which is of sufficient tensile rigidity to avoid any risk of losing its integrity under these loads. In practice this poses problems, particularly if it is desired to form the structure predominantly from plastics materials and to ensure that the structure is of sufficiently light weight for the apparatus to be easily portable. In fact, the structure of a known apparatus made substantially in accordance with that described in U.S. Pat. No: 1,453,363 strains visibly under the action of the pressure loads set up during carbonation.

It is therefore a particularly preferred feature of the present invention that the housing member includes a coupling assembly which, with the housing member in its second pivotal position, is operable in response to movement of a manipulable control member to make a seal with the open top of a vessel placed upon the platform and around the injection orifice and to secure such vessel to the housing member by gripping the neck of the vessel in such manner as to resist substantially the tendency of the vessel to be expelled downwardly during gas injection. In this way the pressure loads set up during gas injection can be met within the localised region of structure constituting the vessel neck and coupling assembly itself, and these loads need not be transferred through the bottom of the vessel to the platform and base member.

A preferred form of coupling assembly comprises an annular array of claw-like elements located with respect to each other at their root ends and each being resiliently flexible in the radial sense about its root end, an annular member encircling the array of claw-like elements and being movable axially with respect to the elements in response to movement of the control member between a first position towards the root ends of the elements in which the elements adopt a spread position so as collectively to define a generally frusto-conical envelope into and from the larger diameter end of which the neck of a vessel can be inserted and withdrawn, and a second position towards the free ends of the elements in which the free ends of the elements are brought closer together so as, in use, to engage with a complementary formation on the neck of a vessel upon the platform, thereby preventing the withdrawal of the vessel, and annular sealing means located with respect to the claw-like elements to contact the vessel when so inserted. In order to move the annular member between its first and second positions, it may be operatively connected in a screw-threaded manner with a rotatable member which is caused to turn in response to movement of the control member.

It is to be noted that the use of such terms as "insertion" and "withdrawal" hereinabove is simply intended to indicate relative movement between the coupling assembly and the vessel such as to place the vessel neck within or without the envelope defined by the claw-like elements. It is not intended to imply that in use the coupling assembly is to be held stationary while the vessel is moved and in fact the reverse is true, the vessel standing on the platform of the base member while such "insertion" and "withdrawal" is achieved by pivoting the housing member between its first and second positions.

The above mentioned complementary formation of the vessel neck need be no more than e.g. a simple annular bead. Reference has been made above to a control member for operating the gas valve and a control member for operating the coupling assembly. Now although it is quite possible to use separate control members for these two functions, the operation of the apparatus is greatly simplified if a common control member is used for both. This same control member can also be used for subsidiary functions to be described later, so that the whole of the operation can be controlled by a single member.

A construction in accordance with the present invention will now be more particularly described, by way of example, with reference to the accompanying drawings which illustrate a preferred embodiment of a carbonating device notably intended for use in the home or other small establishments for making "fizzy" drinks from mixtures of carbonated water and prepared concentrates, or for carbonating or aerating other beverages such as still wines or milk In the drawings.

Figure 1:
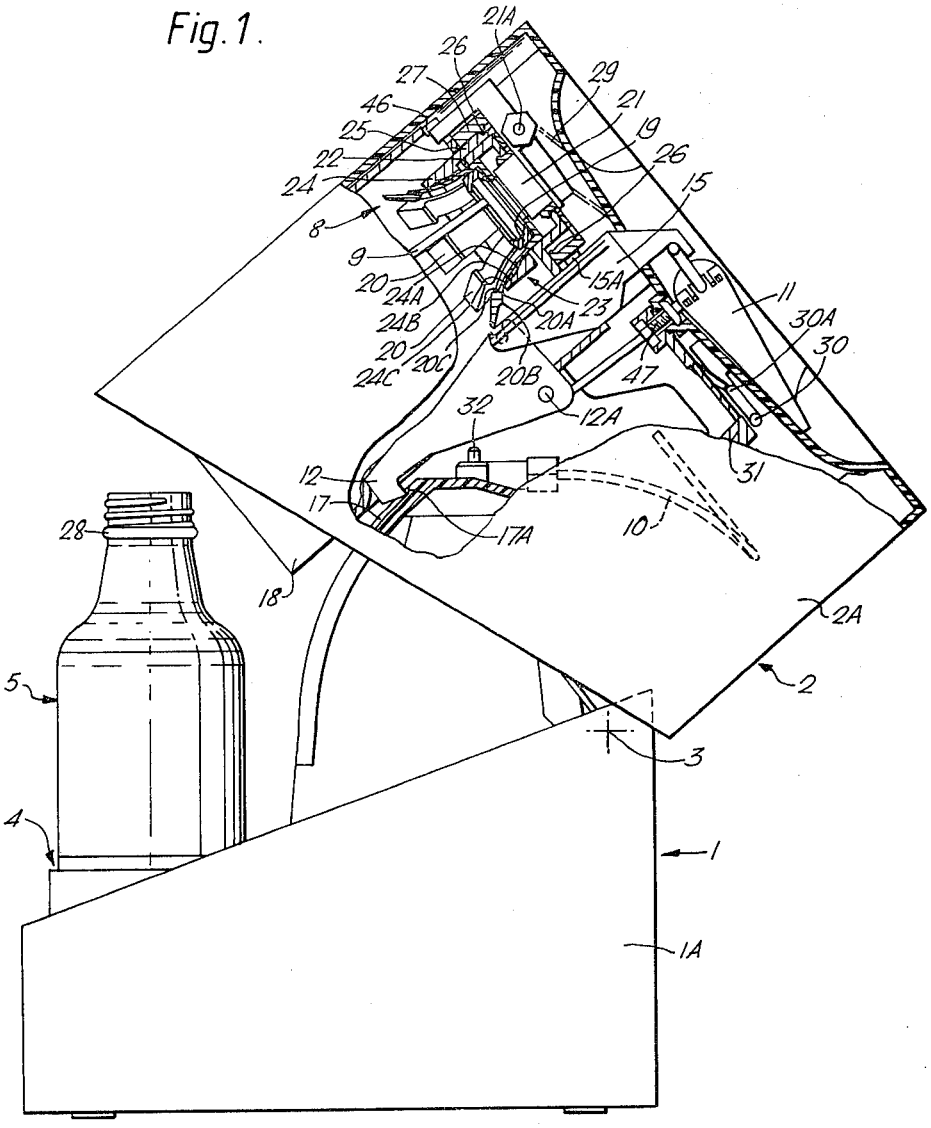
FIG. 1 is a sectional elevation of the carbonator in a first operative condition.
Figure 2:
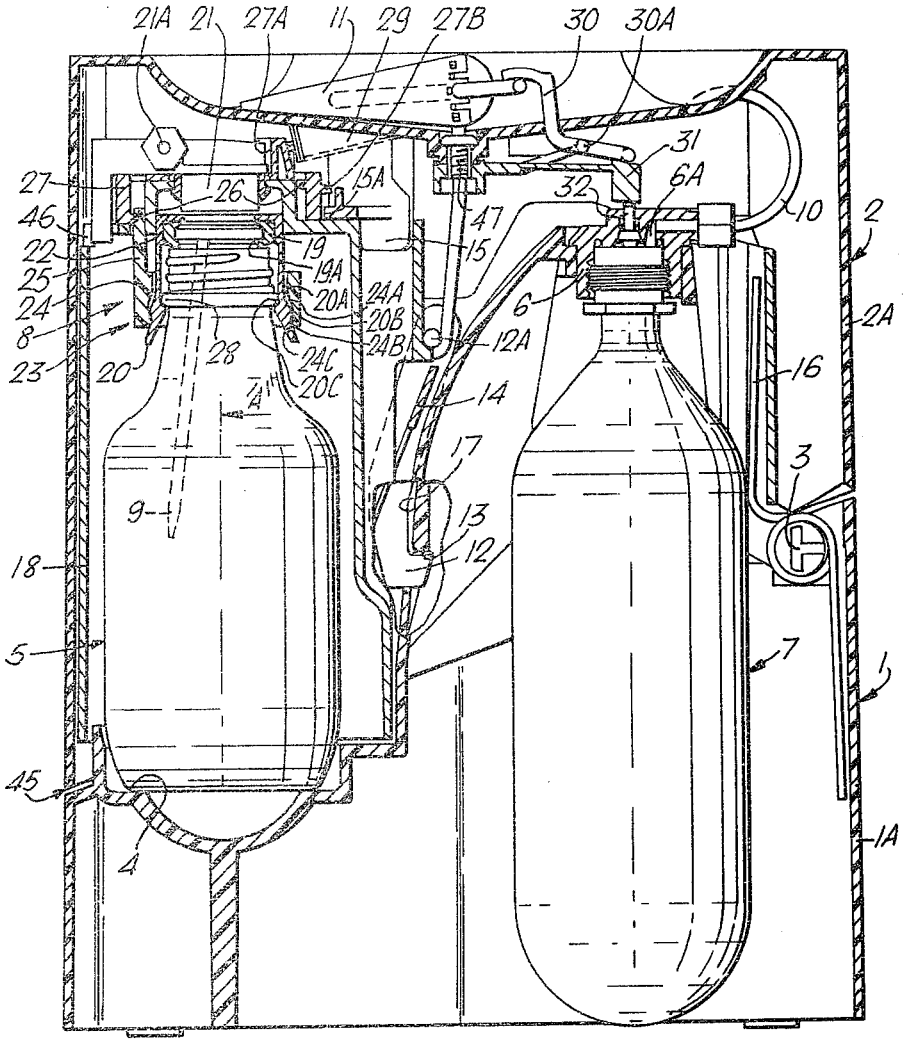
FIG. 2 is a similar view of the carbonator in a second operative condition.

Referring to FIGS. 1 and 2 the carbonator is seen to comprise a base 1 to which a housing 2 is pivoted about a horizontal axis at 3. The base and housing are provided with external fairings 1A and 2A so that when the apparatus is in the "closed" position of FIG. 2 it presents a substantially continuous, smooth exterior surface rectangular in elevation and with rounded ends, of pleasing appearance. The aesthetic appeal of the apparatus can be enhanced by moulding the two fairings in plastics of contrasting colours.

The base 1 includes a platform 4 upon which a bottle 5 containing water or other beverage to be carbonated is stood in use of the apparatus and a coupling to receive a screw-in, re-fillable cylinder 7 of pressurised carbon dioxide. The housing 2 includes a coupling assembly 8 to grip and seal the bottle during carbonation, and an injection orifice in the form of a dip tube 9. A flow line for $CO_2$ gas leads from the cylinder coupling 6 to the dip tube 9 being defined by flexible tubing 10 where it traverses from the base to the housing. The housing also incorporates a single control lever 11 which is used in the performance of the four functions of locking the bottle 5 into the housing, injecting the $CO_2$, venting excess pressure from the bottle and unlocking the housing from the base, as will be more fully described hereinafter.

A cycle of operation of the apparatus will now be described. It is assumed that after the previous usage the carbonator has been left in its closed position, but no bottle 5 is in the apparatus. A charged cylinder 7 has been screwed in place, access for this purpose being gained by an opening in the bottom of base 1.

In this condition the housing is mechanically locked to the base as shown in FIG. 2, by a pair of latch members 12 pivoted to the housing at 12A and engaging in slots 13 provided in the base. These latches are resiliently biased in the anti-clockwise sense (as viewed in the Figures) by plastics leaf springs 14. To withdraw these latches and enable the apparatus to be opened the control lever 11 must be moved clockwise (as viewed in the Figures) to its full extent, i.e. as shown in FIG. 1. As this lever passes the horizontal its tail lifts a link 15 which in turn pivots the latches 12 clear of the slots 13 and allows the housing to rise under the action of a spring 16. As the housing rises the latches 12 run along tracks 17 on the base until a stop 17A is reached. In this condition the strength of spring 16 is sufficient just to counterbalance the weight of the housing tending to return it to the closed position.

The user now places a bottle 5 containing the beverage to be carbonated onto the platform 4 for which, as will be seen from FIG. 1, there is ample access. He then pushes the housing back into the closed position, in so doing the latches 12 running back along the tracks until they encounter, and spring into, the slots 13. In this condition, the control lever 11 adopts a substantially horizontal position, i.e. slightly raised from the extreme position shown in FIG. 1, under the bias of the leaf springs 14 transmitted through link 15.

As the apparatus closes, the dip tube 9 penetrates through the open top of the bottle 5 and into the contained beverage, as shown in FIG. 2. This Figure also shows that the bottle has now been enclosed by a shroud 18 which is secured to the housing within its fairing 2A. This shroud is moulded in a tough, shock resistant plastics material, or made from metal, and is designed to contain the bottle fragments in the event of a bottle shattering during carbonation, thereby protecting the user from injury. Furthermore, in closing the apparatus the coupling assembly 8 has been placed in a position relative to the bottle in which it is ready to grip and seal the same. That is to say the assembly 8 has been brought down with the housing so that its sealing ring 19 comes into contact (or virtually so) with the end of the bottle, but its claws 20 are still in the open position shown in FIG. 1.

Description will now be directed to this assembly 8. A fitment 21 is mounted centrally in the top of the shroud 18. This fitment connects to the dip tube 9 and includes pressure relief valves as will be more fully described hereinafter. Surrounding the fitment 21 is a plastics moulding which defines an annular array of eight equi-spaced claws 20 jointed together at their roots ends by an annular base part 22. Also located within this moulding and surrounding the terminal portion of the fitment 21 is the elastomeric sealing ring 19. Encircling the claws is a clamp ring 23. This element has a continuous annular skirt 24 with three equi-spaced projections 25 (of which one is shown in the Figures) extending upwardly from the skirt through slots provided for the purpose in shroud 18. Each such projection 25 has at its upper end a short part-helical groove which meshes with a respective one of three longer helical formations 26 provided on the internal surface of a ring cam 27 which is borne for rotation through a limited angle externally of the shroud.

In the condition which pertains when the apparatus is initially closed, each of the claws 20 adopts a position in which it extends both axially and radially from its root end so that the claws collectively define a generally frusto-conical envelope the larger diameter end of which freely accommodates the terminal portion of the neck of the bottle 5. By virtue of the threaded connection between the clamp ring 23 and ring cam 27, however, if the ring cam is now rotated through about 90° the clamp ring is caused to descend to the position indicated in FIG. 2, in so doing causing the claws 20 to flex radially inwardly about their root ends to engage the bottle neck and grip it securely in position relative to the housing. More particularly the external profile of each claw 20 includes an axially concave face 20A leading to a protruding shoulder 20B, while its internal profile includes a hook-like concave portion 20C. Interiorly the skirt 24 of clamp ring 23 has a frusto-conical face 24A leading to a cylindrical face 24B and terminates with an inwardly extending lip 24C defining an "entrance" to the clamp ring of smaller diameter than the adjacent cylindrical portion 24B. As the ring cam 27 is rotated and the clamp ring 23 descends, lip 24C of the latter rides down the faces 20A of the claws flexing the claws inwardly against the bottle neck, with further movement the lip 24C snapping past the claw shoulders 20B, the claws thereafter being held in their bottle clamping position by the abutment of the shoulders 20B with the clamp ring surface 24B, in what is effectively a recess defined between the lip 24C and frusto-conical surface 24A. In this condition, shown in FIG. 2, the concave portion 20C of each claw has closed around and under an annular bead 28 provided around the bottle neck, this action tending to lift the bottle slightly against the sealing ring 19.

To rotate ring cam 27 and thereby achieve this gripping of the bottle, the user rotates the control lever 11 anti-clockwise (as viewed in the Figures) until it is substantially horizontal (i.e. not quite in the extreme position shown in FIG. 2). This action causes the ring cam to rotate clockwise (as viewed from above) through the agency of a coil spring 29 linked to the tail of the control lever. In normal operation this spring does not extend substantially, but acts as an ordinary pinned link.

Gas injection can now take place and this is effected by the user continuing the movement of the control lever 11 to the position shown in FIG. 2. In so doing the tail of the control lever lifts a crank 30 which is pivoted to the housing at 30A. The opposite end of the crank is thereby pressed down against a resilient actuator 31 which is in the nature of a leaf spring moulded into the housing. In turn this actuator depresses a plunger 32 provided on the cylinder coupling 6 in the base 1. Finally, this plunger unseats a check valve (not shown) on the cylinder 7 to enable $CO_2$ gas to flow out of the cylinder into a side chamber 6A of the coupling 6. From here the gas is passed through the tube 10 to the inlet 21A of the fitment 21, whence it is transmitted through the dip tube 9 into the beverage within the bottle 5.

The pressure reached within the bottle at this time may typically be in the region of 100 to 150 psi, the injection pressure being limited by a relief valve in the fitment 21 as will be described hereinafter. With this relatively high pressure existing within the bottle, it will be appreciated that the tendency is for the bottle to pull away from the fitment 21. This tendency is checked, however, by the engagement of the claws 20 around the bead 28 of the bottle neck. In turn, the tendency is thus for the claws 20 to be pressed radially outwards by the downward pulling bead 28, but this is prevented by the encircling skirt of the clamp ring 23. In addition, the lip 24C of the clamp ring acts as a detent to resist any possible tendency for the shoulders 20B to disengage from the clamp ring and drive the latter upwards. In this way, the pressure loads set up by the gas injection process are met within the localised region of structure constituting the bottle neck and coupling assembly, and no substantial loads need be transmitted through the bottom of the bottle to the platform 4. In particular, there is thus no tendency for the housing 2 to strain away from the base 1.

At the same time, the relatively high pressure within the bottle is transmitted to the annular space 19A which exists between the fitment 21 and the lip of the sealing ring 19, urging the lip into tight sealing engagement with the end face of the bottle.

Figure 3:
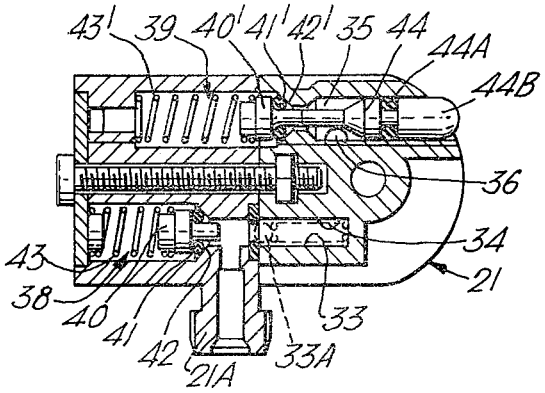
FIG. 3 is a horizontal section through a component of the carbonator of FIGS. 1 and 2.
Figure 4:
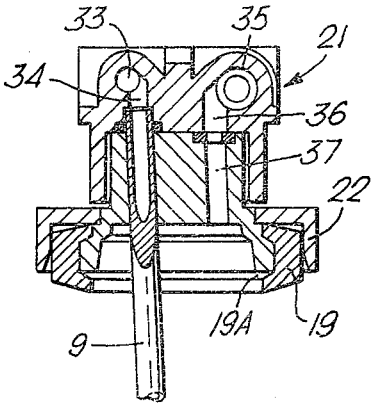
FIG. 4 is a vertical section through the components of FIG. 3.

Turning now to FIGS. 3 and 4, these show more fully the structure of the fitment 21. Its inlet 31A leads to a first passage 33 which communicates with the dip tube 9 via a bore 34. A second passage 35 parallel to the first communicates with the free space in the bottle above the beverage via bores 36 and 37. Connecting with each passage 33 and 35 is a respective pressure relief valve 38, 39. Each such valve comprises a "poppet" 40, 40' provided with an O ring 41, 41' which is urged against a seat 42, 42' under the action of a spring 43, 43'. The spring characteristics are chosen such that the valve 39 will open by leftward (as viewed in FIG. 3) movement of its poppet 40' under a chosen pressure P1 in passage 35 in the range 100 to 150 psi, whereas the valve 38 will open under a higher chosen pressure P2 in its passage 33 in the range 150 to 200 psi. Additionally, valve 39 is provided with an actuator 44 slidably sealed to passage 36 by an O ring 44A, whereby the poppet 40' can be mechanically unseated against the bias of its spring 43', the purpose of which will appear hereinafter.

Returning to the description of the operating sequence of the carbonator, gas injection has taken place and as a result the pressure within the bottle has risen. This pressure is transmitted via bores 37 and 36 to passage 35 and accordingly relief valve 39 opens when the pressure reaches P1, to vent excess gas through a side bore (not shown) opening to the left (as viewed in FIG. 3) of the poppet 40'. That this stage has been reached will be signalled to the user by the sound of the escaping gas and furthermore by the fact that in practice the poppet 40' will vibrate under the opposing forces of its spring 43' and the pressure in the passage 35. In the unlikely event that relief valve 39 fails to open, or fails to vent the excess pressure as fast as the inflow through dip tube 9, the pressure in passage 33 will rise above its normal operational value and when a pressure of P2 is reached relief valve 38 will open and vent excess pressure through a side bore (not shown) opening to the left (as viewed in FIG. 3) of the poppet 40. By this means, the pressure reached within the bottle should under no circumstances rise to more than the relief value P2 of the valve 38. A possible reason for valve 39 failing to vent excess pressure sufficiently quickly would be if the user attempted to carbonate an unsuitable beverage which frothed unduly, so that the valve became partially choked with liquid. Even if this occurred valve 38 would be unaffected because it is located on the supply side (i.e. upstream of dip tube 9) and back flow of liquid along the dip tube is unlikely to occur. If desired, this could be ensured by including a non-return valve 33A in the passage 33 as indicated in phantomn in FIG. 3.

Having reached the limiting pressure in bottle 5, the beverage is now carbonated and the user can release the operating lever, allowing it to return to a substantially horizontal position under the action of the linkage 30, 31, 32. As the gas takes a finite time to enter solution, however, the user may if desired be able to increase the level of carbonation somewhat by waiting for a moment and then depressing the lever again to give the beverage another short "burst" of gas, but this action will not serve to increase the limiting pressure in the bottle above the level P1 set by relief valve 39.

To release the bottle from the coupling assembly 8 the control lever 11 is moved clockwise (as viewed in the Figures) to rotate ring cam 27 back into its position illustrated in FIG. 1. This raises the clamp ring 23, its lip 24C snapping back past the claw shoulders 20B and allowing the claws to resile outwardly and disengage from the bottle neck. However, following carbonation there will still be a pressure P1 in the free space of the bottle, and it is desirable that this pressure be relieved while the claw shoulders 20B are still in contact with the cylindrical portion 24B of the clamp ring skirt, to avoid the violent disengagement of bottle and claws. Consequently the ring cam is provided with a track 27A (FIG. 2) which, as soon as the cam begins its return rotation, comes into contact with a protruding portion 44B of the actuator for relief valve 39 (FIG. 3) to mechanically open that valve and vent the remaining pressure from the bottle to atmosphere. The track 27A is, in fact, of such a length that the relief valve 39 is kept open at all times except when the ring cam is in the position in which the bottle is fully engaged by the claws 20. It is thereby ensured that this valve is exercised immediately before gas injection, and that if there should be any tendency for the valve to stick then it will stick in its open rather than in its closed position.

Following the release of the bottle from assembly 8, further movement of the control lever 11 into its position shown in FIG. 1 is effective to unlock the housing 2 from the base as earlier described, allowing the apparatus to be opened and the bottle of carbonated beverage to be removed. The whole cycle can then be repeated with a new bottle of beverage. When as many bottles as desired have been carbonated, it is recommended to close the apparatus for storage by pivoting down the housing until it locks to the base.

From the foregoing it will be appreciated that although a substantial number of separate functions take place during an operating cycle of the carbonator the apparatus is in practice extremely simple and easy to use. The loading and unloading of the bottle from the apparatus is considerably improved over the previously discussed prior art and once the apparatus is closed the operating cycle is performed simply by the movement of a single lever from one extreme position to another and back again. Indeed the whole operation of bottle loading, carbonation and unloading can easily be performed with one hand.

Furthermore, the carbonator employs a number of important safety features, as follows. By virtue of the coupling assembly 8, the carbonation pressure loads are "locked up" in that assembly and the bottle neck, and there is no tendency for the apparatus to strain or for the housing to come away from the base. During carbonation the bottle is enclosed by a double wall comprising the shroud 18 and fairing 1A, to protect the user from any injury in the event of a bottle shattering under the applied gas pressure. In this unlikely event, the pressure can vent in a controlled manner through the restricted opening 45 at the base of the bottle compartment and a slot 46 at the top. There is a relief valve 39 to vent excess pressure from the bottle and this valve is kept open at all times except when ready to carbonate, as described. As a back-up there is the second relief valve 38.

Part of the linkage which operates the cylinder valve to admit gas to the bottle (i.e. the actuator 31) is mounted to the housing, while the next element in the linkage (the plunger 32) is mounted to the base. Consequently, unless the housing is properly down and locked these elements will not come into sufficient register for the cylinder valve to be operated. It is therefore impossible to pressurise a bottle except when safely enclosed.

A pair of latches 12 keep the housing locked to the base during carbonation. In addition, there is an interlock system between the latching mechanism and the mechanism whereby the coupling assembly 8 is operated which will now be described. The link 15 by which the latches 12 can be disengaged carries a stop bar 15A. Furthermore, the ring cam 27 carries an external cam track 27B (FIG. 2). The relative disposition of these two members is such that if the housing is not properly down, or the latches 12 for any other reason fail to engage in the slots 13, the link 15 will be in its upper position as shown in FIG. 1, and in this position the stop bar 15A will block the rotation of the ring cam by protruding into the path of its track 27B. Consequently, unless the housing is properly locked to the base the ring cam cannot be moved away from its FIG. 1 position. A bottle therefore cannot be gripped and properly sealed by the coupling assembly 8. Furthermore the relief valve 39 is held in its open position. Still further, as the movement of ring cam 27 is blocked the control lever 11 cannot be moved to its gas injecting position. If the user should try to force the movement of the lever 11 the spring 29 will extend to prevent damage being inflicted to the mechanism, and will return the lever to its starting position when released. Assuming, however, that the latches 12 are properly engaged, when the ring cam 27 is rotated its track 27B runs over the stop bar 15A as shown in FIG. 2, to prevent any possibility of the link rising and the latches disengaging while the apparatus is in a position for gas injection to be performed.

Finally, the apparatus is designed so that the user does not have access to the operating mechanisms and cannot tamper with them. The housing fairing 2A which encloses the vital components is fixed by a single screw 47 to the body of the housing. This screw, however, is masked by the control lever 11 and the latter is so designed that it can only be removed by the user breaking it apart. This does not preclude, however, servicing being carried out by the manufacturer or other authorised bodies who would have facilities for removing and replacing the lever 11.

We claim:

1. An apparatus for injecting gas under pressure into liquid contained in an open-topped vessel, said apparatus comprising a base member including a platform fixed thereto to support the vessel, a housing member pivoted to the base member about a generally horizontal axis spaced horizontally from said platform, the housing member including a gas injection orifice, a coupling for receiving a source of compressed gas and connected to a conduit defining a flow path to lead gas from such source to the injection orifice, a manipulable control member, and means for controlling the flow of gas from said gas source, said means being operable in response to movement of said control member to permit or prevent the flow of gas to said orifice, the housing member being pivotal between a first position which permits the vessel to be placed upon or removed from said platform without penetration of the injection orifice into the vessel, and a second position in which the injection orifice penetrates through the top of the vessel previously placed upon the platform.

2. An apparatus according to claim 1 wherein said housing member includes a coupling assembly which, with the housing member in its second pivotal position, is operable in response to the movement of a manipulable control member to make a seal with the open top of the vessel upon the platform and around the injection orifice and to secure the vessel to the housing member by gripping the neck of the vessel in such manner as to resist substantially the tendency of the vessel to be expelled downwardly during gas injection.

3. An apparatus according to claim 2 wherein the coupling assembly comprises an annular array of claw like elements having free ends and root ends, said elements being located with respect to each other at their root ends and each being resiliently flexible in the radial sense about its root end, an annular member encircling the array of claw-like elements and being movable axially with respect to the elements in response to movement of the control member between a first position towards the root ends of the elements in which the elements adopt a spread position so as collectively to define a generally frusto-conical envelope into and from the larger diameter end of which the neck of a vessel can be inserted and withdrawn, and a second position towards the free ends of the elements in which the free ends of the elements are brought closer together so as, in use, to engage with a complementary formation on the neck of a vessel upon the platform, thereby preventing the withdrawal of the vessel, and annular sealing means located with respect to the claw like elements to contact the vessel when so inserted.

4. An apparatus according to claim 3 and including a rotatable member, the annular member being operatively connected in a screw threaded manner with said rotatable member; and means for turning said rotatable member in response to movement of the control member and thus to move the annular member between its first and second positions.

5. An apparatus according to claim 2 or claim 3 in which a common control member operates the gas valve and the coupling assembly.

6. An apparatus according to claim 5 wherein the sealing means are so formed that fluid pressure within the vessel is effective to urge the sealing means against the vessel.

7. An apparatus according to claim 1 wherein the housing member includes a shock resistant shroud which, when the housing member is in its second pivotal position, envelopes a vessel previously placed upon the platform.

8. An apparatus according to claim 5 in which means to operate a valve on the gas source comprise a valve operating member and linkage for transmitting the movement of the common control member to the valve operating member to operate the valve to permit the flow of gas through the flow path, the arrangement being such that the linkage is effective to transmit such movement from the control member to the valve operating member only when the chassis member is in its second pivotal position.

9. An apparatus according to claim 8 wherein the common control member is located on the housing member, the valve operating member is located on the base member and the linkage includes a member which, when the housing member is in its second pivotal position, can come into contact with the valve operating member to transmit the movement of the common control member thereto but which is moved away from the valve operating member to prevent such transmission of movement when the housing member is moved out of its second pivotal position.

10. An apparatus according to claim 5 comprising means biased to lock the housing member to the base member when the housing member is in its second pivotal position, and means for unlocking the housing member when so locked in response to the movement of the common manipulable control member.

11. An apparatus according to claim 10 comprising means to bias the housing member into its first pivotal position whenever the housing member is not locked in its second pivotal position.

12. An apparatus according to claim 10 comprising means to prevent the flow of gas through the flow path, if the housing member is not locked to the base member.

13. An apparatus according to claim 1 comprising a first pressure relief valve which, when the housing member is in its second pivotal position, is placed in communication with the interior of a vessel previously placed upon the platform and which is adapted to open to atmosphere when the pressure within the vessel reaches a chosen value during the injection of gas into liquid contained therein.

14. An apparatus according to claim 13 further comprising means for opening said first pressure relief valve to atmosphere irrespective of the pressure within the vessel in response to the movement of the common manipulable control member.

15. An apparatus according to claim 14, wherein said first pressure relief valve is maintained open to atmosphere whenever said coupling assembly is not effective to secure the vessel to the housing member.

16. An apparatus according to claim 13 comprising a second pressure relief valve in communication with the flow path and means for opening said second pressure relief valve to atmosphere if the pressure within the flow path reaches a chosen value greater than said chosen value at which said first pressure relief valve is adapted to open.

17. An apparatus according to claim 16 comprising a non-return valve in the flow path downstream of said second pressure relief valve.

18. An apparatus according to claim 17 wherein the common control member is in the form of a lever capable of pivoting over a predetermined range of movement, at one end of which the lever unlocks the housing member from the base member and at the other end of which the lever operates to permit the flow of gas through the flow path.

19. An apparatus according to claim 18 wherein, in moving from the one end to the other, the lever operates the coupling assembly to secure a vessel to the housing member.

20. An apparatus according to claim 19 wherein in moving in the reverse direction from the other end of the range to the one end, the lever sequentially opens said first pressure relief valve and operates the coupling assembly to release a vessel from the housing member.

* * * * *